United States Patent [19]

Finzer et al.

[11] Patent Number: 4,607,517

[45] Date of Patent: Aug. 26, 1986

[54] STAMPING AND BENDING TOOL ASSEMBLY

[75] Inventors: Heinz Finzer; Wolfgang Kessler, both of Bad Säckingen, Fed. Rep. of Germany

[73] Assignee: Heinz Finzer KG, Bad Säckingen, Fed. Rep. of Germany

[21] Appl. No.: 590,335

[22] Filed: Mar. 16, 1984

[30] Foreign Application Priority Data

Apr. 8, 1983 [DE] Fed. Rep. of Germany ..... 3312671

[51] Int. Cl.[4] ..... B21J 9/18

[52] U.S. Cl. ..... 72/449; 72/384; 72/446

[58] Field of Search ..... 72/402, 403, 404, 449, 72/481, 381, 384, 446; 140/105, 140; 74/411.5, 813 L, 444, 445, 530

[56] References Cited

U.S. PATENT DOCUMENTS

| | | | |
|---|---|---|---|
| 1,799,236 | 4/1931 | Hunt | 140/140 |
| 3,260,091 | 7/1966 | Shaw | 72/449 |
| 3,296,851 | 1/1967 | Breuer | 72/386 |

FOREIGN PATENT DOCUMENTS

| | | | |
|---|---|---|---|
| 2737442 | 3/1979 | Fed. Rep. of Germany . | |
| 3013460 | 10/1981 | Fed. Rep. of Germany . | |
| 944378 | 12/1963 | United Kingdom | 72/402 |
| 2073071 | 10/1981 | United Kingdom | 140/105 |

OTHER PUBLICATIONS

Draht, vol. 12, p. 713 (1978).
Maschinenmarkt, No. 71, p. 94, Sep. 6, 1977.

*Primary Examiner*—Lowell A. Larson
*Assistant Examiner*—Robert Showalter

[57] ABSTRACT

A stamping and bending tool assembly is described for automatically making bent parts of wire or strip or like raw materials. The tool assembly comprises a plurality of bending carriages which are grouped around a circular tool carrier table with central work station and secured to the housing frame and are controlled by respective cams driven by a respective drive pinion engaged in a central ring gear. The central work station is preceded by at least one cutting tool working in timed sequence with the bending carriages and possibly by at least one take-in apparatus for raw material. The bending carriages together with the cutting tool and possibly with the take-in apparatus for raw material are combined on the circular tool carrier table to form a tool group unit positively driven by way of the central ring gear and the drive pinions in mesh therewith, and the tool carrier table is in the form of a quick replacement plate centrally connected to the housing frame and with which the mutual angular relationship obtaining during the operation of the tool assembly for all the tool drive pinions can be secured when the replacement plate is removed. By means of this high-power tool assembly, it is possible to minimize the prolonged down times hitherto necessarily occurring during replacement of the bending-shaping tool.

46 Claims, 7 Drawing Figures

STAMPING AND BENDING TOOL ASSEMBLY

BACKGROUND OF THE INVENTION

1. Field of the Invention

The invention relates to a stamping and bending tool assembly and particularly to an extremely high number of cycles at a high capacity and high precision of operation.

2. Description of the Related Art

Conventional tool assemblies of the above-mentioned kind are constructed so that each bending and cutting tool forms a separate tool unit of the assembly and must be mounted as such in the tool or housing frame in an exact spatial relationship to the other tools in such a way that the tools operate in an accurately timed relationship to each other. The bending carriages are grouped about a central work station containing the actual bending tool and preceded by a cutting apparatus and a take-in apparatus for the raw material, these two additional partial tool apparatuses being provided with a separate branch drive.

The drives for the cutting and take-in apparatuses must likewise be tuned to operate exactly in timed sequence with the movement of the bending carriage, and very specific movements for the cutting and feeding mechanism are required for each part to be bent. When replacing the tool of the assembled bending carriages relatively long assembly times are still necessary for setting the feeding drive mechanisms for the separator die, which, incidentally, has to be mounted on a separate press, and the take-in carriage for the raw material to the new paths of the individual bending carriages and to the new dimensions of the bent parts. During such assembly, the stamping and bending tool assembly cannot be embodied in the production process and the time required for conversion therefore represents a down time through which the economy of the stamping and bending tool assembly is considerably reduced or at least severely limited, especially in the case of small production series or when the tools have to be changed frequently.

SUMMARY OF THE INVENTION

It is an object of the present invention to provide a high capacity stamping and bending tool assembly that can be operated more economically particularly in the case of small production series.

According to the invention, the cutting tool and possibly also the take-in tool for the raw material is integrated with the conventionally separate pure bending tool and preferably in such a way that a unit of tool groups is formed. The unit of tool groups comprises different types of tools which are nevertheless driven centrally and of which the unifying element is on the one hand the tool carrier table with regard to the mutual spatial disposition of the individual tools and on the other hand the central ring gear with regard to the control of movement that is tuned with respect to time. The central ring gear is permanently and forcibly coupled with all the tools, even those of different kinds, by way of pinions and cam plates or eccentrics. This unitary structure which is heterogeneous and combined to a unit of groups by the central drive and the tool carrier table offers the additonally advantages of making the unit of tool groups in the form of independent and separately manipulatable and thus selectively exchangeable structure which is releasably applied to the housing frame for rapid replacement. For this purpose, the construction of the tool carrier table serves as a replacement and especially a quick replacement plate comprising centering means and securing means with the aid of which one can reliably prevent the set angular interrelationship of the individual pinion shafts from being altered when the tool group unit is withdrawn from the frame thereby avoiding the adjustment necessary that would involve additional valuable assembly time. Since the unit of tool groups can therefore be freely handled as a whole when uncoupled from the central ring gear drive without having to put up with relative displacement of the drive pinions, the unit of tool groups can for example be completely pre-assembled beyond the automatically operating tool assembly without interfering with the continued operation of the tool assembly during this pre-assembly phase. The down times of the tool assembly are therefore reduced solely to the periods required to couple the unit of tool groups to the housing frame and to the central ring gear. During this phase, the centering means in conjunction with the adjusting means that become effective when applying the unit of tool groups contribute towards a further reduction in the down times so that the stamping and bending tool assembly can be economically used particularly for small series. Another particularly advantageous application of the bending tool assembly is in the case of small recurring series because the pre-assembled tool group unit is then temporarily held in reserve and immediately ready for use when required without any renewed setting.

The preferred embodiment is of particular advantage because this type of centering is very reliable and insensitive on the one hand and can be brought about at little tooling expense on the other hand.

The preferred embodiment also has the particular advantage that on the one hand the central application of the quick replacement plate to the housing frame is simplified and can therefore be carried out in a shorter time and on the other hand the centering means which are precision made are protected as far as is possible by these pre-centering means so that their life is increased and the engagement of the teeth is facilitated.

In the preferred embodiment the adjusting means will always assume or maintain the correct position relatively to the housing frame when removed from the housing frame as well as when re-attached to the housing frame and when engaging the drive pinions in the central ring gear all the drive elements for the bending carriages, for the take-in apparatus of the raw material and for the cutting or stamping apparatus. A first variation of these adjusting means is that the locking apparatuses may operate frictionally or positively. With these locking apparatuses it is possible reliably to obtain the predetermined disposition of all the driven gears of the tools so that the tool group unit removed from the housing frame or pre-assembled in an assembly frame can be coupled to the housing frame again with completely accurate cam plate or eccentric positions, the multiplicity of drive pinions for the bending carriages, press and take-in apparatus being necessarily and correctly engaged in the central drive gear. The principal advantage of this construction is the economical manufacture of the adjusting apparatuses because these adjusting apparatuses have to take up comparatively smaller forces and can therefore be built to a smaller size.

The preferred embodiment offers the particular advantage that during removal of the tool group unit not a single additional manipulation is necessary for maintaining the correct predetermined position for the angular dispositions of the individual drive pinion shafts. This brings about an additional saving in converting time, which is beneficial for the economy of using the tool. When using the tool group unit with the adjusting means of this construction it is merely necessary to make sure that the central drive wheel or gear engages some part of its drive pinion. In the removed condition, the central drive gear can be turned at will without thereby changing the mutual angular relationship of all the tool drive pinions required during operation of the tool assembly.

Almost the same advantages regarding simple manipulation of the adjusting means are achieved with a segmented central drive ring gear. This construction provides the additional advantage that the tool group unit can be much lighter in weight. In this construction, the central drive gear or the central drive ring gear is segmented so that one part remains on the tool group unit when this is removed and the other part remains on the housing frame. As in the case of the previously described embodiment, the part of the driving ring gear mounted on the quick replacement plate reliably ensures that in the removed condition of the tool group unit there can be no relative rotation of the individual drive pinion shafts of all the tools. During renewed assembly of the tool group unit it is only necessary to ensure that the two parts of the central driving ring gear are brought to a position in which the engageable and disengageable parts of the rotary coupling are positioned in axial registry on opposite sides of the gear halves. At this instant, all the teeth of the two gear halves will also be in registry so that an exactly tuned operation of the different tools of the tool group unit is ensured.

The adjusting means can be simplified further whilst maintaining very simple manipulation when re-assembling the tool group unit, the additional advantage being obtained that the tool group unit to be manipulated can be of still lighter weight. In this embodiment it is again only necessary to bring the teeth into axial registry whereby to ensure automatic and gentle engagement of all the drive pinions of the tool group unit with the central driving ring gear.

A further embodiment provides simpler and yet more accurate positioning of the bending carriages in their main operating directions. In a preferred construction the fitting grooves are applied at the constant angular spacing of 30° in the quick replacement plate.

It has already been suggested to provide a replaceable carrier plate for bending carriages on a frame of a bending tool. However, in these tools the cutting tool preceding the bending tools and mounted on a separate press as well as the take-in tool for the raw material must be individually replaced independently of the replacement plate, i.e. they have to be set to the newly inserted bending tool in spatial arrangement as well as with respect to the time control, thereby losing valuable operating periods for the tool assembly.

BRIEF DESCRIPTION OF THE DRAWING

Several embodiments of the invention will now be described in more detail with reference to diagrammatic drawings, wherein:

FIG. 3 is a sectional view of the stamping and bending tool assembly of FIG. 2 with the section in a vertical axial plane of the bending tool assembly, only one bending carriage being illustrated for the sake of simplicity;

DESCRIPTION OF THE PREFERRED EMBODIMENT(S)

Figure 1:
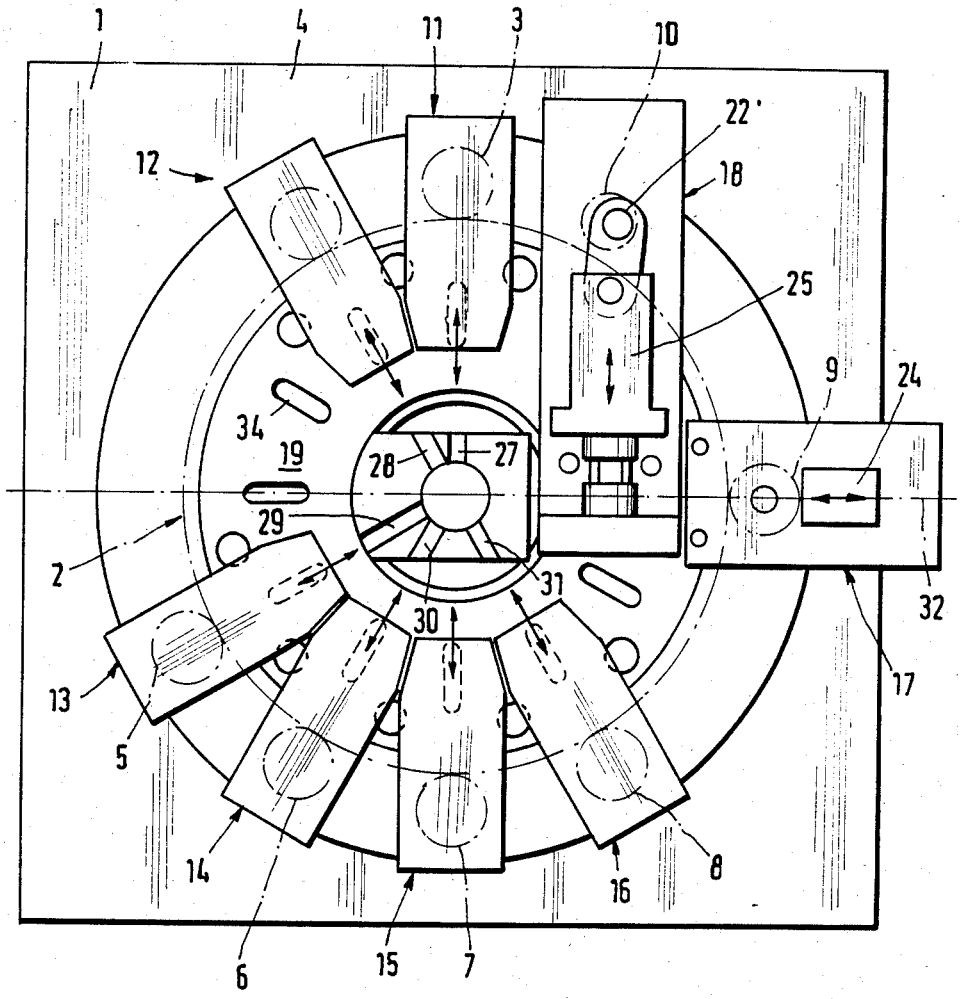
FIG. 1 is a front elevation of the high capacity stamping and bending tool assembly.

The stamping and bending tool illustrated in FIGS. 1 to 7 servng, for example, for the automatic manufacture of bending parts of wire, strip or like raw materials comprises a frame 1 substantially in the form of a box and mainly extending in a vertical plane. In the frame 1 there is provided a central driving station in the form of a central driving ring gear or drive gear 2 which is merely diagrammatically illustrated by the chain-dotted circle in FIGS. 1 and 2. The central drive gear 2 is driven by a drive pinion 37 which is, for example, coupled to an electric motor. The drive gear also serves to drive a mutiplicity of drive pinions 3 to 10, again diagrammatically illustrated in FIGS. 1 to 2. Each drive pinion 3 to 10 belongs to a separate operating tool 11 to 18 secured in a predetermined spatial relationship to each on a tool carrier table 19 fixed to a housing frame. The tool carrier table 19 is seen from the front in FIGS. 1, 2 and 7. All the tools 11 to 18 are respectively driven by way of a pinion drive shaft 20 which is fixed to rotate with the associated pinion 3 to 10 (FIG. 2 only shown the pinion drive shaft 20 of the tool 11), extends through a tool housing 21, and carries at its end 44 remote from the pinion 3 (to 10) a tool drive, for example a cam plate group 22 or an eccentric 22', whereby the operating stroke as well as the return stroke of an associated tool carriage 23 (in the case of the tools 11 to 16) or 24 (in the case of the tool 17) or 25 (in the case of the tool 18) is brought about.

Apart from the operating dies secured to the carriage slides and not shown in more detail, the tools 11 to 16 are identical and usually function as pure bending tools co-operating with a bending shaping tool 26 accommodated at the center of the tool carrier table 19. The bending tool 26 thus forms a central work position about which the cam-controlled bending tools are grouped. As is seen from FIGS. 1 and 2, the bending tool 26 has a number, corresponding to the number of bending carriages, of die guides 27 to 31 for guiding the respective bending dies, which, while exactly tuned to each other with respect to time by the cam control, engage in the tool 26 for deforming the wire or strip raw material received therein. During one rotation of the central driving ring gear 2, the individual bending carriages 11 to 16 execute several working and return strokes, which means that a plurality of bent workpieces can be made during each rotation of the driving ring gear 2.

Figure 2:
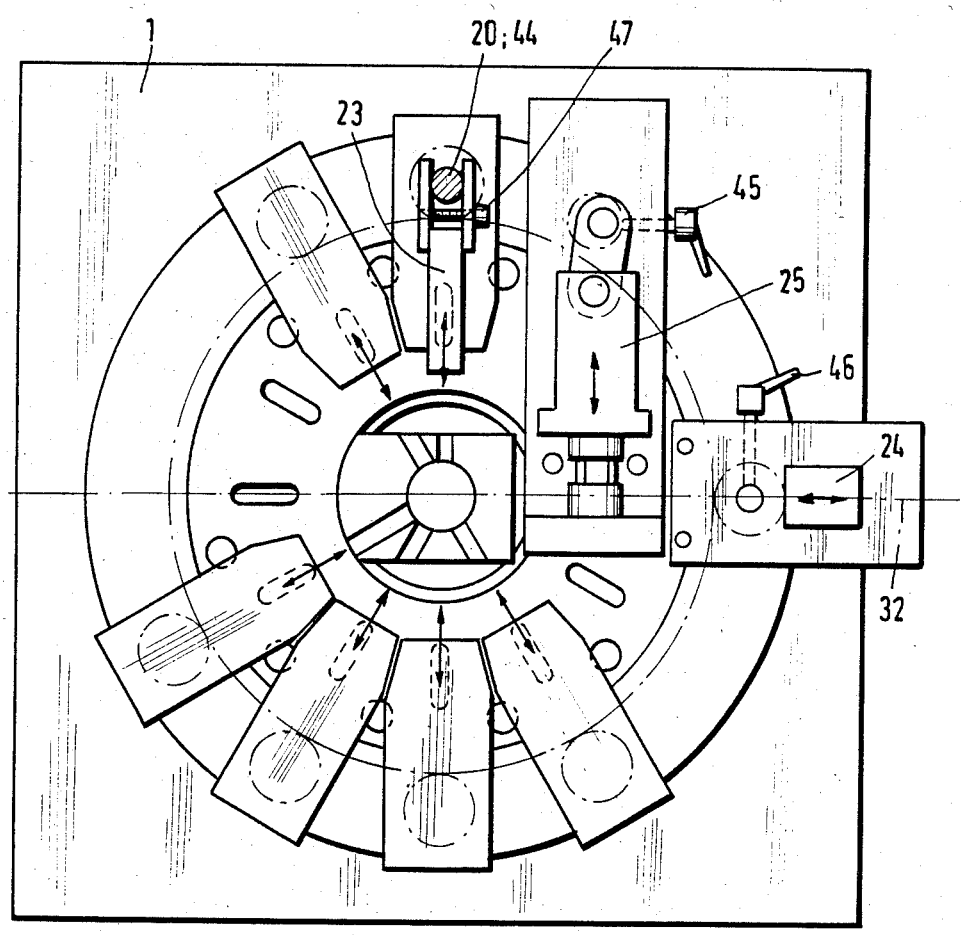
FIG. 2 is a view of the tool assembly corresponding to FIG. 1 with a first embodiment of adjusting and locking means for the respective drive pinion shafts of the individual tools mounted on the quick replacement plate.
Figure 1:
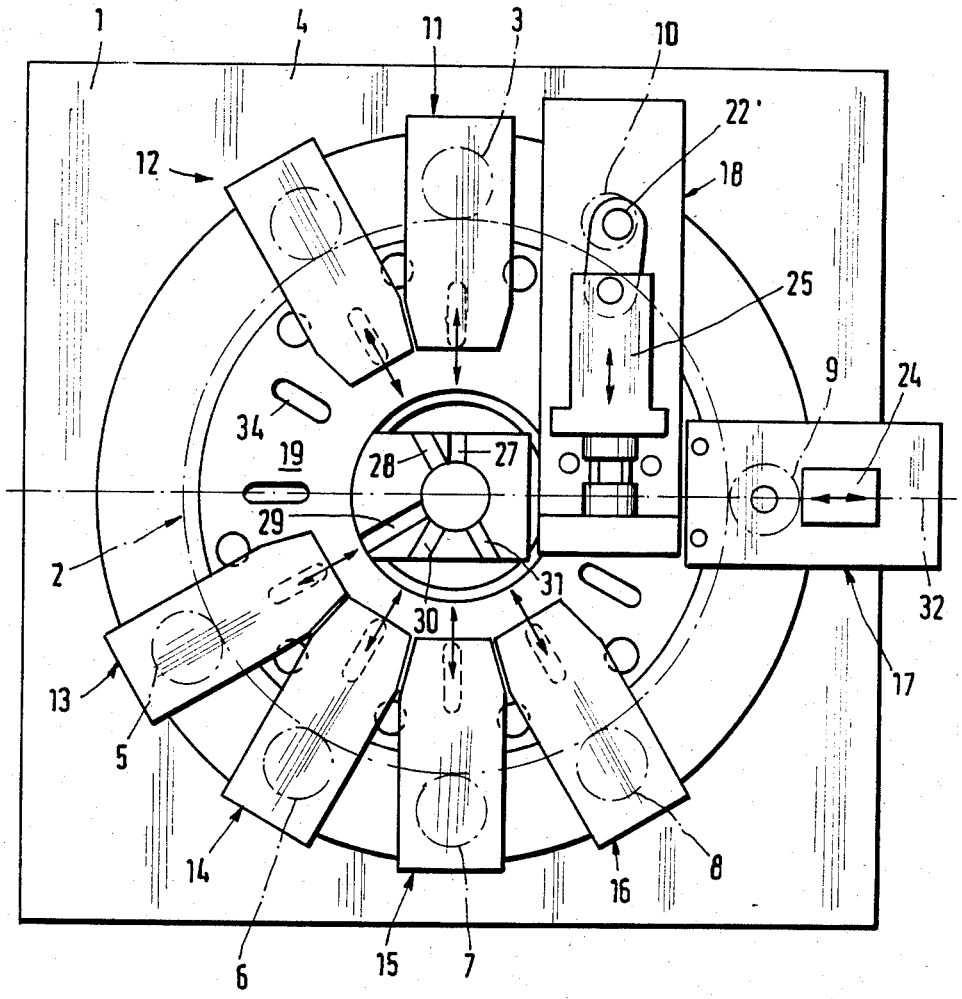

As shown in FIGS. 1 and 2, the bending tool 26 forming the central work station is preceded by at least one cutting tool 18 and the latter by take-in apparatus 17 for the raw material so that automatic working of the tool assembly is made possible. Line 32 indicates the axis along which the raw material, i.e. the wire or strip to be bent, is fed to the bending tool assembly.

As already mentioned previously, the tool carriages 24 and 25 of the tools 17 and 18 preceding the bending tool 26 are also driven by way of drive pinions 9 or 10 directly engaging with the central driving ring gear 2. The carriages 24 and 25 are again controlled by cam or eccentric, namely in a manner such that the carriage movements are precisely tuned to each other in time as well as to the carriage movements of the bending tools 11 to 16. The mutually correctly interrelated operating movement of the individual tools is generally achieved by adjusting the individual cam plate groups 22 or eccentrics 22' to each other.

The principal peculiarity of the novel stamping and bending tool assembly is, apart from the single central driving ring gear 2 for all the tools 11 to 18 enabling automatic operation, to be seen in the fact that all the bending tools 11 to 16 as well as the cutting tool 18 and possibly the take-in apparatus 17, if such is provided for the raw material, are combined on the circular tool carrier table 19 to form a separately manipulatable tool group unit. The tool carrier table 19 is for this purpose in the form of a quick replacement plate on which the individual tools 11 to 18 are mounted in a fixed position and which is in turn releasably attached to the frame 1, for example at a radially inner annular flange 33 (see FIGS. 3, 5 and 6). The tool group unit shown as a whole in FIGS. 1 and 2 is therefore readily releasably connected to the frame 1 and can be removed therefrom as a whole, the individual tools 11 to 18 mounted on the quick replacement plate forming the tool carrier table 19 retaining their relative dispositions without change. For safely securing the tools there are, for example, T grooves for receiving clamping claws and/or radial plate recesses 34 extending in main working directions $R_A$ for receiving fitting keys which facilitate positioning of the tools.

FIGS. 3 to 6 illustrate the T grooves or recesses 35 as well as the recesses 34 for receiving fitting keys 36.

Figure 4:
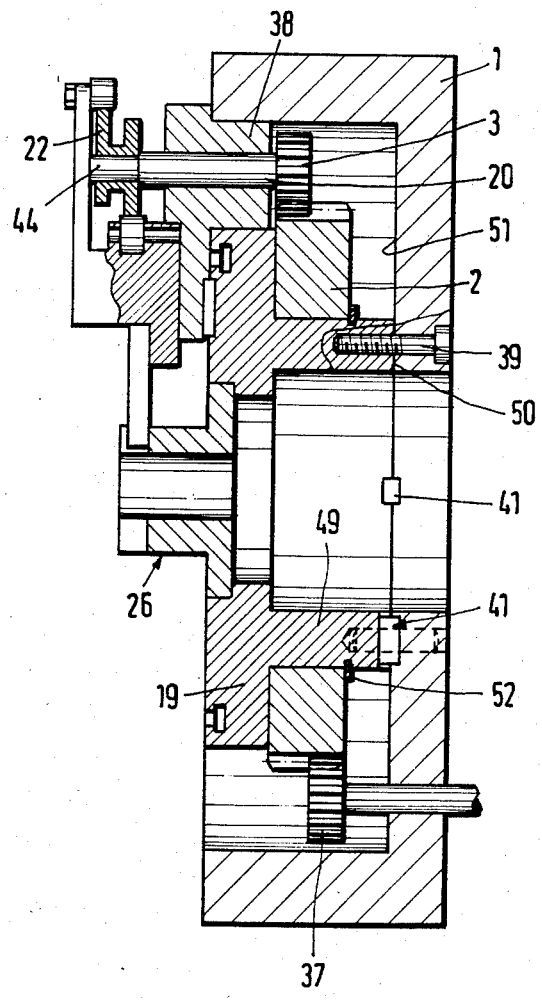
FIGS. 4 to 6 are views corresponding to FIG. 3 of three further embodiments of the bending tool assembly with different adjusting means for the tool driving pinions and FIG. 7 is a view similar to FIG. 1 of a further embodiment of the bending tool assembly with the tools removed.
Figure 5:
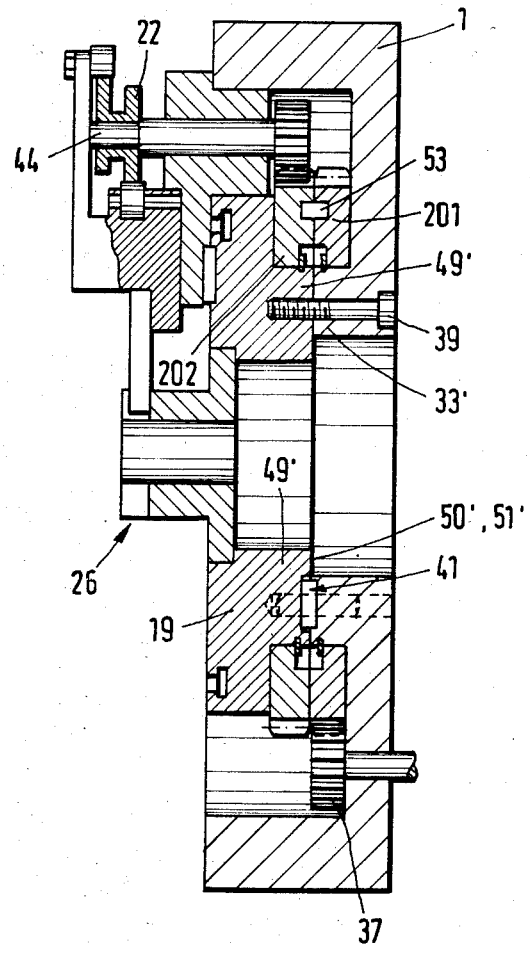
Figure 6:
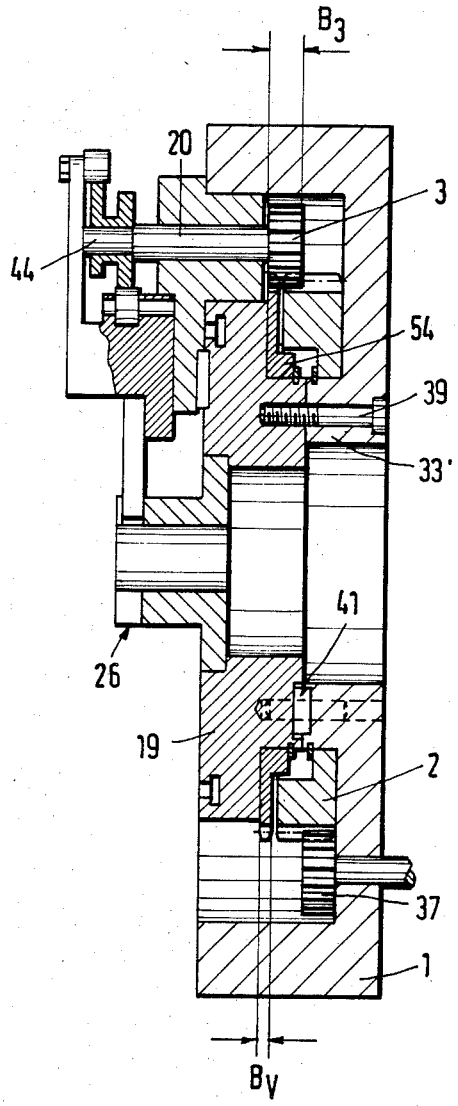

FIGS. 3 to 6 clearly show that the assembly of the tools 11 to 18 on plate 19, which is, for example, a simple turned part, takes place so that, in the secured condition of the tools, the drive pinions 3 to 10 come into full engagement with the central driving ring gear 2 which, in the illustrated embodiments, is in the form of a central drive gear which, according to the structures in FIGS. 3 and 6, is mounted on the radial flange 33 in the frame 1. On the underside of frame 1 in the illustrations of FIGS. 3 to 6 one can see the drive pinion 37 which is driven by a main drive motor.

For securely fixing the tools 11 to 18 to the tool carrier table 19 in the form of a quick replacement plate, each tool carriage carrier 21 possesses a centering collar 38 which fits into the radial annular space between the outside of the table plate 19 and the inner surface of the housing frame 1.

FIG. 1 shows the automatically operating combined cutting and bending tool assembly in the final assembled condition in which it can be put into operation. In this condition, the tool carrier table 19 is centrally secured to the housing frame 1 by way of releasably securing means 39, for example in the form of screws which are screwed into the back of the table plate 19. For the purpose of pre-centering, additional guide columns 40 are provided which are merely indicated in broken lines in FIGS. 3 to 6. For the secure and reliable attachment to the frame 1 of the tool group unit consisting of the table plate 19 with the tools 11 to 18 mounted thereon, centering means 41 are additionally provided in the region of the opposed radial faces 42, 43 of the table plate 19 and connecting flange 33, respectively. By means of the centering means 41, the opposed end faces 42 and 43 can be brought into positive surface contact. The centering means 41 can for example be formed by Hirth-type separation. In the illustrated embodiments of the invention, these centering means are formed by a simple key and groove connection. For the purpose of this connection, the back of the table plate 19 as well as the annular surface of the connecting flange 33 comprise a plurality, for example four, equally angularly spaced radial grooves for receiving a complementary block so that, when the appropriate grooves are brought into axial registry with each other, secure centering of the table plate 19 on the frame 1 will be ensured.

If the previously described tool group unit is to be removed from the frame 1, it is merely necessary to loosen the securing screws 39, whereupon the entire tool group unit can be moved axially away from the frame 1. In the FIG. 3 embodiment, all the drive pinions 3 to 10 of tools 11 to 18 disengage from the central driving gear ring 2. At this instant, however, the coupling of all the drive pinions 3 to 10 that until then obtained by way of the central driving ring gear 2 is released so that the individual drive pinions 3 as well as the drive pinion shafts 20 connected thereto for rotation therewith and the tool drives 22 or 22' seated thereon would, without some additional provision, turn relatively to each other under the effect of gravity of the individual tool carriages. Such mutual rotation would upset the adjusted angular relationship of all the tool drive pinions or tool drives 22 or 22' so that, upon renewal application of the tool group unit to the frame 1, the individual tools 11 to 18 would no longer work in the predetermined timed succession. In addition, application of the tool group unit would generally be difficult because the individual drive pinions 3 to 10 would turn to such an extent that not all the tooth gaps of the drive pinions 3 to 10 come to engage in the teeth of the central driving ring gear 2. This, however, would undesirably increase the replacement times for the combined cutting and bending tool assembly. For this reason, the tool group unit is provided with adjusting or locking means with which the mutual angular association of all the tool drive pinions 3 to 10 established during operation of the tool assembly can be maintained without alteration even when the table plate 19 is removed.

A modification of these adjusting or locking means is illustrated in FIGS. 2 and 3. Each tool 11 to 18 or each drive pinion shaft 20 of these tools is associated in the region of the tool drives 22 or 22' with a locking apparatus 48 which is operable by a manual lever 45 or 46 or clamping screw 47 and which can, for example, engage between the cam plate group 22. The locking apparatuses 45 to 47 so engage the drive pinion shaft 20 and on the other hand the tool carriages 23 or carriage carriers 24 or 25 that, upon pulling on the levers 45 to 47, the respective drive pinion shaft 20 is reliably secured against rotation. The locking apparatus 47 can work frictionally as well as through positive engagement. If each drive pinion shaft 20 is secured against rotation by such a locking apparatus, the entire tool group unit can be removed from the frame 1 after loosening the securing screws 39 without the danger of the different drive pinion shafts 20 and thus the tool drives 22 or 22' turning with respect to each other. This means that the removed tool group unit with locked pinion shafts 20 can be mounted and, when required, i.e. upon a recurring product series, conveniently re-attached to the frame 1 without experiencing difficulties in engaging the individual pinions 3 to 10 with the central driving ring gear 2. When one pinion 3 engages in the ring gear 2, the tooth gaps of the other pinions will necessarily register with the correct tooth gaps of the driving ring gear 2 so that the conversion time is limited to a minimum. For centrally positioning the tool group unit there are, as already previously mentioned, the centering means 41 in the opposed planar faces 42 and 43. In addition, for the purpose of pre-centering there are column guides 40 with which the table plate 19 is moved axially towards the frame 1. This further simplifies the engagement of the teeth.

FIG. 4 shown a further embodiment of the tool group unit. Components corresponding to those shown in the FIGS. 1 to 3 embodiment are referenced with the same numerals. The main difference from the FIG. 3 embodiment resides in the fact that the central drive gear 2 is no longer mounted on the axial flange 33 of the frame 1 but on an axial extension 49 of the table plate 19. The centering means 41 are therefore disposed between the annular face 50 of the axial extension 49 and the rear planar face 51 of the housing frame 1. The central drive gear 2 is located on the axial extension 49 of the table plate 19 with the aid of an axial securing ring 52.

In this embodiment, the previously described adjusting means for fixing the mutual angular relationship of all the tool drive pinions is formed by the central drive gear 2 itself which is removed together with the tool group unit when the table plate 19 is removed. The individual pinions can thereby turn mutually in the removed condition but not out of their angular relationship and, upon re-applying the tool group unit, it is merely necessary to ensure that the drive pinion 37 gently engages in the central drive gear 2.

FIG. 5 illustrates a further embodiment of the combined cutting and bending tool assembly, the components employed in the previously described embodiments again being designated by the identical reference numerals. This embodiment differs from that in FIG. 4 in that the central drive gear 2 is segmented. One gear half 201 is mounted for rotation but against axial displacement on a shortened axial flange 33' of the housing frame 1. The other gear half 202 is rotatable but not axially displaceable on a short axial extension 49' of the table plate 19. Both gear halves 201 and 202 are provided with identical teeth. One gear half 201 engages with the drive pinion 37 whereas the other gear half 202 is in mesh with all drive pinions 3 to 10 of the tools 11 to 18. In the assembled condition of the tool group unit, the two gear halves 201 and 202 are interengaged by way of a releasable axially engageable and disengageable rotary clutch 53. To remove the tool group unit from the frame 1, the securing screws 39 are again released and the table plate 19 with the gear half 202 mountd thereon can be removed as a whole by undoing the rotary clutch 53 and the centering means 41. The gear half 202 again ensures that the set angular relationship of all the drive pinion shafts 20, all the tool drives 22 or 22' secured thereon is not changed in the withdrawn condition of the tool group unit. Upon renewed application of the tool group unit, it is merely necessary axially to align the claws of the axially engageable and disengageable rotary clutch 53 and the tool assembly can be incorporated in the operating process after tightening the securing screws 39.

A further embodiment is shown in FIG. 6. This embodiment differs from that in FIG. 5 merely in that the gear half 202 mounted on the table plate 19 is replaced by an auxiliary gear 54 of which the teeth are identical with those of the central drive gear 2. The width of toothing $B_V$ of the auxiliary gear 54 is considerably less than the width $B_3$ of pinion 3 which can therefore engage with the central drive gear 2 in the built-on condition of the tool group unit. The difference of this embodiment from that of FIG. 5 therefore resides in the fact that the pinion 3 itself assumes the function of the axially engageable and disengageable rotary clutch 53 of the FIG. 5 embodiment. In the removed condition of the tool group unit, the auxiliary gear 54 assumes the same function as the gear half 202 of FIG. 5. This means that, upon renewed attachment of the table plate 19 whenever a drive pinion can engage with the central drive gear 2, all the other drive pinions can necessarily be freely brought into mesh therewith without any forcing.

Figure 7:
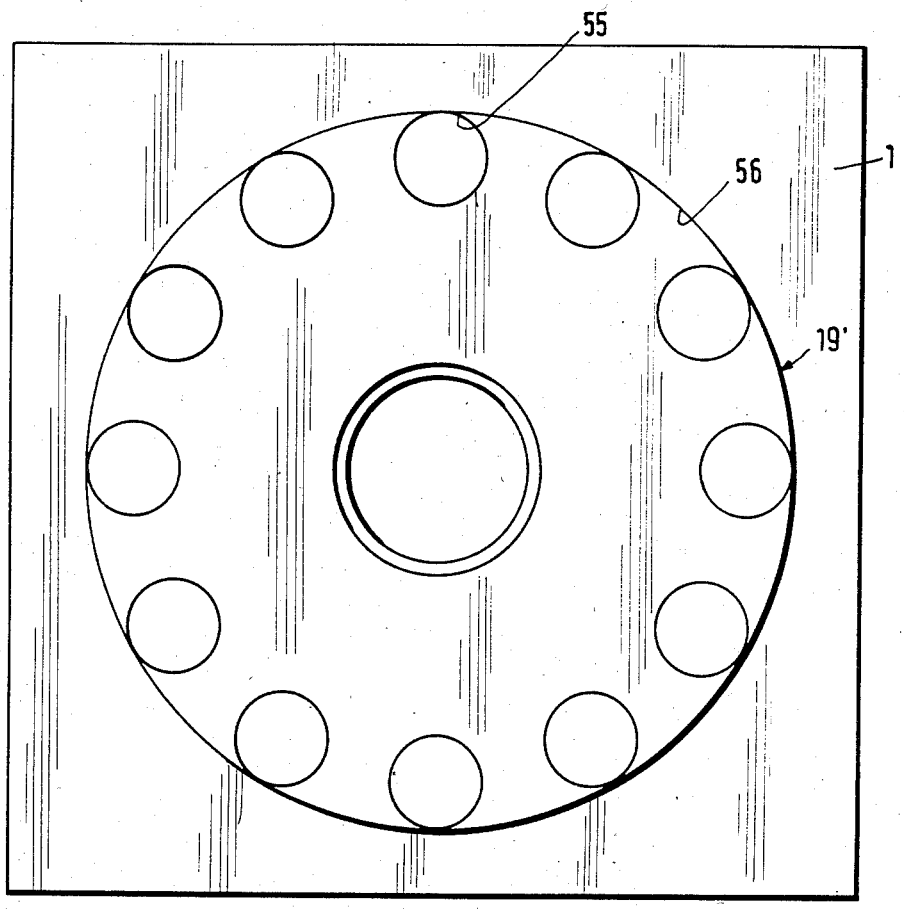

FIG. 7 illustrates a different construction for the quick replacement plate forming the total carrier table 19. In addition to or instead of the radial grooves 34 shown in FIGS. 1 and 2 and at predetermined angular spacings of for example 30° to each other, the table plate 19' extends somewhat further radially outwardly and comprises a ring of holes 55 serving to receive the respective centering or guide collars 38 of the individual tools 11 to 18. The table plate 19' can again be a turned part centrally received in a turned recesses 56 of the housing frame 1. The cross-slot centering 41 is preferably retained.

From the foregoing description it will be clear that the illustrated frame 1 may also function as a pre-assembled frame on which, during continuous production of the actual tool assembly, a new tool group unit is built up around a new bending-shaping tool and, as a whole, can then be applied to the frame while maintaining the preadjusted angular relationship of all the pinion drive shafts. Directly after connecting the quick replacement table plate, the tool assembly is finished for productive operation with the new bending shaping tool.

The invention is of course not restricted to the illustrated embodiments. In particular, the invention makes it possible, in departure from the illustrated embodiments, to mount a plurality of cutting tools and take-in tools for the raw material on the central quick replacement table plate 19, 19' without thereby foregoing any of the previously described advantages of the invention.

The invention thus provides a combined cutting and bending tool assembly for the automatic manufacture of bent parts of wire, strip or like raw materials. The tool assembly comprises a plurality of bending carriages which are grouped about a circular housing frame that is secured to the tool carrier table and has a central work station and are respectively controlled by cams respectively driven by way of a drive pinion engaging a central driving ring gear. The central work station is preceded by at least one cutting tool working in timed relationship to the bending carriages and possibly by at least one take-in apparatus for the raw material. Together with the cutting tool and possibly the take-in apparatus, the bending carriages are combined on the circular tool carrier table to form a tool group unit which is forcibly driven by way of the central driving ring gear and the pinions in mesh therewith, and the tool carrier table is in the form of a quick replacement plate having centering means for connection to the housing frame and adjusting means with which the mutual angular relationship of all the tool drive pinions obtaining during operation of the tool assembly can be fixed when the replacement plate is removed. With the aid of this high-capacity tool assembly it is possible to minimize the prolonged down times that were hitherto inevitable during replacement of the bending-shaping tool.

Various modifications in structure and/or function may be made to the disclosed embodiments by one skilled in the art without departing from the scope of the invention as defined by the claims.

What is claimed is:

1. A stamping and bending tool assembly for automatically manufacturing bent parts comprising:

a housing frame supporting a plurality of carriage means, the carriage means being disposed around a circular tool carrier table means having a central work station and a bending tool, each carriage means controlled by respective cam means engaging respective pinion means, the respective pinion means engaging a common central drive gear means;

the table means comprising a quick replacement plate having centering and securing means for establishing a fixed mutual angular relationship of the respective pinion means and against movement when the replacement plate is removed to selectively change the bending tool.

2. A tool assembly according to claim 1, wherein the centering means are formed by a positive surface connection between opposed planar faces of the quick replacement plate and the housing frame.

3. A tool assembly according to claim 2, wherein the positive surface connection is formed by a groove and key connection, there being at least three angularly spaced grooves and keys.

4. A tool assembly according to claim 2, wherein the opposed planar faces of the quick replacement plate and the housing frame comprise grooves which are disposed opposite each other in axial registry to receive complementary blocks.

5. A tool assembly according to claim 2, wherein the positive surface connection is formed by spur gearing.

6. A tool assembly according to claim 1 or 2 or 3 or 4 or 5 wherein the quick replacement plate is secured to the housing frame by means of a screw connection.

7. A tool assembly according to claim 1 or 2 or 3 or 4 or 5 comprising precentering means for axially guiding the quick replacement plate relatively to the housing frame.

8. A tool assembly according to claim 7, wherein the precentering means are formed by a column guide for the quick replacement plate.

9. A tool assembly according to claims 1 or 2 or 3 or 4 or 5 wherein the securing means comprises a respective locking means for each carriage means whereby the pinion means are selectively secured against movement.

10. A tool assembly according to claim 9, wherein the central ring gear means is mounted at a fixed location in the housing frame and is secured therein against axial displacement independently of the quick replacement plate.

11. A tool assembly according to claim 1 or 2 or 3 or 4 or 5 wherein the securing means comprises the central ring gear means which is mounted on the quick replacement plate and can be removed from the housing frame together therewith.

12. A tool assembly according to claims 1 or 2 or 3 or 4 or 5 wherein the securing means comprises a segmented central ring gear means having a first and second segment, the first segment being mounted on the replacement plate and secured against axial movement and the second segment being mounted on the housing frame, the first and second segments having complementary teeth, the first and second segments being connected by a releasable axially engageable and disengageable rotary clutch.

13. A tool assembly according to claim 12 wherein the second gear segment comprises an adjusting gear having a tooth width which is only a fraction of the width of the pinion means and the clutch comprises the respective pinion means and the first gear segment in meshing engagement therewith.

14. A tool assembly according to claims 1 or 2 or 3 or 4 or 5 wherein the replacement plate extends radially beyond the pinion means, the plate including a circle of throughgoing holes for receiving centering collars for the carriage means.

15. A tool assembly according to claim 12, wherein the pinion means can be brought into mesh engagement exclusively with the second segment mounted on the quick replacement plate.

16. A tool assembly according to claim 1 or 2 or 3 or 4 or 5 wherein the quick replacement plate comprises radially extending fitting grooves for centering the carriage means.

17. A tool assembly according to claim 3 wherein the opposed planar faces of the quick replacement plate and the housing frame comprise grooves which are disposed opposite each other in axial registry to receive complementary blocks.

18. A tool assembly according to claim 6 comprising precentering means for axially guiding the quick replacement plate relatively to the housing frame.

19. A tool assembly according to claim 6 wherein the securing means comprises a respective locking means for each carriage means whereby the pinion means are selectively secured against movement.

20. A tool assembly according to claim 7 wherein the securing means comprises a respective locking means for each carriage means whereby the pinion means are selectively secured against movement.

21. A tool assembly according to claim 8 wherein the securing means comprises a respective locking means for each carriage means whereby the pinion means are selectively secured against movement.

22. A tool assembly according to claim 6 wherein the securing means are formed by a driving ring gear which is mounted on the quick replacement plate and can be removed from the housing frame together therewith.

23. A tool assembly according to claim 7 wherein the securing means are formed by a driving ring gear which is mounted on the quick replacement plate and can be removed from the housing frame together therewith.

24. A tool assembly according to claim 8 wherein the securing means are formed by a driving ring gear which is mounted on the quick replacement plate and can be removed from the housing frame together therewith.

25. A tool assembly according to claim 6 wherein the securing means are formed by a ring gear which is mounted on the quick replacement plate and secured against axial displacement and of which the teeth are identical with those of the central driving ring gear mounted in the housing frame, the ring gear being connected to the ring gear by way of a releasable axially engageable and disengageable rotary clutch.

26. A tool assembly according to claim 7 wherein the securing means are formed by a ring gear which is mounted on the quick replacement plate and secured against axial displacement and of which the teeth are identical with those of the central driving ring gear mounted in the housing frame, the ring gear being connected to the ring gear by way of a releasable axially engageable and disengageable rotary clutch.

27. A tool assembly according to claim 8 wherein the securing means are formed by a ring gear which is mounted on the quick replacement plate and secured against axial displacement and of which the teeth are identical with those of the central driving ring gear mounted in the housing frame, the ring gear being connected to the ring gear by way of a releasable axially engageable and disengageable rotary clutch.

28. A tool assembly according to claim 6 wherein the quick replacement plate comprises radially extending fitting grooves for centering the carriage means.

29. A tool assembly according to claim 7 wherein the quick replacement plate comprises radially extending fitting grooves for centering the carriage means.

30. A tool assembly according to claim 8 wherein the quick replacement plate comprises radially extending fitting grooves for centering the carriage means.

31. A tool assembly according to claim 9 wherein the quick replacement plate comprises radially extending fitting grooves for centering the carriage means.

32. A tool assembly according to claim 10 wherein the quick replacement plate comprises radially extending fitting grooves for centering the carriage means.

33. A tool assembly according to claim 11 wherein the quick replacement plate comprises radially extending fitting grooves for centering the carriage means.

34. A tool assembly according to claim 12 wherein the quick replacement plate comprises radially extending fitting grooves for centering the carriage means.

35. A tool assembly according to claim 15 wherein the quick replacement plate comprises radially extending fitting grooves for centering the carriage means.

36. A tool assembly according to claim 13 wherein the quick replacement plate comprises radially extending fitting grooves for centering the carriage means.

37. A tool assembly according to claim 6 wherein the quick replacement plate extends radially beyond the drive pinion shafts and for centered reception of which comprises a circle of throughgoing holes serving to receive centering collars for the carriage means.

38. A tool assembly according to claim 7 wherein the quick replacement plate extends radially beyond the drive pinion shafts and for centered reception of which comprises a circle of throughgoing holes serving to receive centering collars for the carriage means.

39. A tool assembly according to claim 8 wherein the quick replacement plate extends radially beyond the drive pinion shafts and for the centered reception of which comprises a circle of through-going holes serving to receive centering collars for the carriage means.

40. A tool assembly according to claim 9 wherein the quick replacement plate extends radially beyond the drive pinion shafts and for the centered reception of which comprises a circle of through-going holes serving to receive centering collars for the carriage means.

41. A tool assembly according to claim 10 wherein the quick replacement plate extends radially beyond the drive pinion shafts and for the centered reception of which comprises a circle of through-going holes serving to receive centering collars for the carriage means.

42. A tool assembly according to claim 11 wherein the quick replacement plate extends radially beyond the drive pinion shafts and for the centered reception of which comprises a circle of through-going holes serving to receive centering collars for the carriage means.

43. A tool assembly according to claim 12 wherein the quick replacement plate extends radially beyond the drive pinion shafts and for the centered reception of which comprises a circle of through-going holes serving to receive centering collars for the carriage means.

44. A tool assembly according to claim 15 wherein the quick replacement plate extends radially beyond the drive pinion shafts and for the centered reception of which comprises a circle of through-going holes serving to receive centering collars for the carriage means.

45. A tool assembly according to claim 13 wherein the quick replacement plate extends radially beyond the drive pinion shafts and for the centered reception of which comprises a circle of through-going holes serving to receive centering collars for the carriage means.

46. A tool assembly according to claim 16 wherein the quick replacement plate extends radially beyond the drive pinion shafts and for the centered reception of which comprises a circle of through-going holes serving to receive centering collars for the carriage means.

* * * * *